US005673748A

United States Patent [19]

May et al.

[11] Patent Number: 5,673,748

[45] Date of Patent: Oct. 7, 1997

[54] HEATING CHAMBER FOR SOLID MATERIAL

[75] Inventors: Karl May, Bad Vilbel; Hartmut Herm, Dreieich; Karlheinz Unverzagt, Seligenstadt; Helmut Werdinig, Nürnberg, all of Germany

[73] Assignee: Siemens Aktiengesellschaft, Munich, Germany

[21] Appl. No.: 599,383

[22] Filed: Feb. 9, 1996

Related U.S. Application Data

[63] Continuation of PCT/DE94/00864, Jul. 26, 1994.

[30] Foreign Application Priority Data

Aug. 9, 1993 [DE] Germany ..... 43 26 679.7

[51] Int. Cl.[6] ..... F28F 19/00

[52] U.S. Cl. ..... 165/92; 165/134.1; 34/134; 34/138; 432/107; 432/118

[58] Field of Search ..... 165/92, 134.1; 34/135, 141, 142, 138, 134; 366/147, 225; 432/103, 105, 107, 111, 114, 116, 118

[56] References Cited

U.S. PATENT DOCUMENTS

| | | | |
|---|---|---|---|
| 1,488,216 | 3/1924 | Overton | 432/107 X |
| 1,891,705 | 12/1932 | Delas | 165/92 |
| 2,286,654 | 6/1942 | Simpson et al. | 165/92 X |
| 2,511,309 | 6/1950 | Hemminger | 432/118 X |
| 2,646,818 | 7/1953 | Bimpson | 165/134.1 X |
| 2,715,517 | 8/1955 | Bosner | 34/142 X |
| 2,848,198 | 8/1958 | Bill | 34/135 X |
| 4,619,314 | 10/1986 | Shimoda | 165/134.1 X |
| 5,154,648 | 10/1992 | Buckshaw | 165/134.1 |
| 5,220,957 | 6/1993 | Hance | 165/134.1 |

FOREIGN PATENT DOCUMENTS

| | | | |
|---|---|---|---|
| 0 157 330 | 10/1985 | European Pat. Off. . | |
| 0 302 310 | 2/1989 | European Pat. Off. . | |
| 665325 | 9/1929 | France | 34/141 |
| 606836 | 12/1934 | Germany | 34/134 |
| 37 02 318 | 1/1988 | Germany . | |
| 38 30 153 | 3/1990 | Germany . | |

*Primary Examiner*—Leonard R. Leo

*Attorney, Agent, or Firm*—Herbert L. Lerner; Laurence A. Greenberg

[57] ABSTRACT

A heating chamber is rotatable about its longitudinal axis and contains a number of heating tubes orientated parallel to each other. Solid material which is lifted up during the rotation can become detached from the heating tubes and upon impact can lead to damage to heating tubes which are situated below. In order to prevent such an occurrence, baffle shells are provided on the heating tubes. The baffle shells are formed of a resistant material and offer protection against surface damage. The heating tubes are preferably disposed in radially orientated rows.

13 Claims, 2 Drawing Sheets

HEATING CHAMBER FOR SOLID MATERIAL

CROSS-REFERENCE TO RELATED APPLICATION

This application is a continuation of International Application Serial No. PCT/DE94/00864, filed Jul. 26, 1994.

BACKGROUND OF THE INVENTION

Field of the Invention

The invention relates to a heating chamber for solid material, preferably to a low-temperature carbonization chamber for waste, being rotatable about its longitudinal axis and having a number of heating tubes situated in the interior thereof.

The heating chamber is used for thermal waste disposal, preferably according to the low-temperature carbonization combustion process.

In the waste disposal field, the so-called low-temperature carbonization combustion process has become known. The process and a plant operating according thereto for thermal waste disposal are described, for example, in Published European Patent Application 0 302 310 A1, corresponding to U.S. Pat. No. 4,878,440, as well as in German Published, Non-Prosecuted Patent Application DE 38 30 153 A1. The plant for thermal waste disposal according to the low-temperature carbonization combustion process contains, as essential components, a low-temperature carbonization chamber (pyrolysis reactor) and a high-temperature combustion chamber. The low-temperature carbonization chamber converts the waste which is delivered through a waste transport device, into low-temperature carbonization gas and pyrolysis residue. The low-temperature carbonization gas and the pyrolysis residue, after suitable reprocessing, are then fed to the burner of the high-temperature combustion chamber. In the high-temperature combustion chamber, molten slag forms, which is taken off through a discharge and which is present in vitreous form after cooling. The resulting flue gas is fed through a flue gas pipe to a stack as an outlet. A waste heat steam generator as a cooling device, a dust filter plant and a flue gas purification plant are preferably installed in the flue gas pipe.

The low-temperature carbonization chamber (pyrolysis reactor) being used is generally a low-temperature carbonization drum rotating about its longitudinal axis, which low-temperature carbonization drum is provided in the interior with a number of parallel heating tubes by which the waste is heated substantially in the absence of air. The low-temperature carbonization drum rotates about its longitudinal axis in that case. Preferably, the longitudinal axis of the low-temperature carbonization drum is somewhat at an angle to the horizontal, so that the low-temperature carbonization material collects at the exit of the low-temperature carbonization drum and from there can easily be discharged. Upon rotation, the waste being lifted up falls onto the heating tubes situated beneath. Since the waste can contain heavy components, such as stones, bottles, ceramic parts and iron parts, for example, there is the risk that the heating tubes will be damaged and erode during rotation. During the impact, small particles can split off from the surface of the heating tubes. The replacement of the heating tubes is time-consuming and expensive.

SUMMARY OF THE INVENTION

It is accordingly an object of the invention to provide a heating chamber for solid material, which overcomes the hereinafore-mentioned disadvantages of the heretofore-known devices of this general type and which protects heating tubes in the heating chamber against damage by falling solid material and thus increases their operating life.

With the foregoing and other objects in view there is provided, in accordance with the invention, a solid waste treatment apparatus, comprising a heating chamber, preferably a low-temperature carbonization chamber, for solid material, the heating chamber having an interior and a longitudinal axis and being rotatable about the longitudinal axis; a number of heating tubes disposed in the interior of the heating chamber; and baffle shells disposed on the heating tubes.

The baffle shells assume the function of a protective cladding, so that with heat transfer substantially undisturbed, damage to the actual heating tubes by falling solid material is almost completely avoided. Exchange of the heating tubes is thus required only after relatively long time intervals, if at all.

In accordance with another feature of the invention, the baffle shells are constructed as half-shells. Such half-shells can be attached relatively simply to the heating tubes, and they provide protection over a large surface area.

The baffle shells are also certainly a cost factor. In addition, the heat transfer is impaired a little at their location. In order to provide an inexpensive solution with good heat transfer, in accordance with a further feature of the invention, the baffle shells only extend over part of the total length of the heating tubes.

In accordance with an added feature of the invention, in a low-temperature carbonization chamber for waste, it is sufficient if the baffle shells only extend over about one third of the total length.

It has already been explained that in a low-temperature carbonization chamber the longitudinal axis can be at an angle to the horizontal. In accordance with an additional feature of the invention, in such a heating chamber or low-temperature carbonization chamber it is sufficient to mount the baffle shells only on the lower or bottom end of the heating tubes, since an accumulation of the heavier parts of the waste results at the end and thus in this region there is a particular hazard from falling solid material. The baffle shells at the particularly critical lower end region of the heating tubes therefore prevent the destruction of the surface of the heating tubes, at least over the course of a relatively long period.

In accordance with yet another feature of the invention, the baffle shells are formed of steel.

In accordance with yet a further feature of the invention, the baffle shells are welded onto the heating tubes, and are each preferably provided with tack welds for this purpose.

In accordance with yet an added feature of the invention, the heating tubes are disposed parallel to each other in roughly radially orientated rows.

In accordance with a concomitant feature of the invention, in order to achieve particularly effective protection, the baffle shells cover parts of the heating tubes, which are upper parts, when the heating tubes are in a position in a range of 30° to 60°, and preferably at 45°, from the lowest position of the heating tubes, as seen in a direction of rotation of the heating chamber.

Other features which are considered as characteristic for the invention are set forth in the appended claims.

Although the invention is illustrated and described herein as embodied in a heating chamber for solid material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
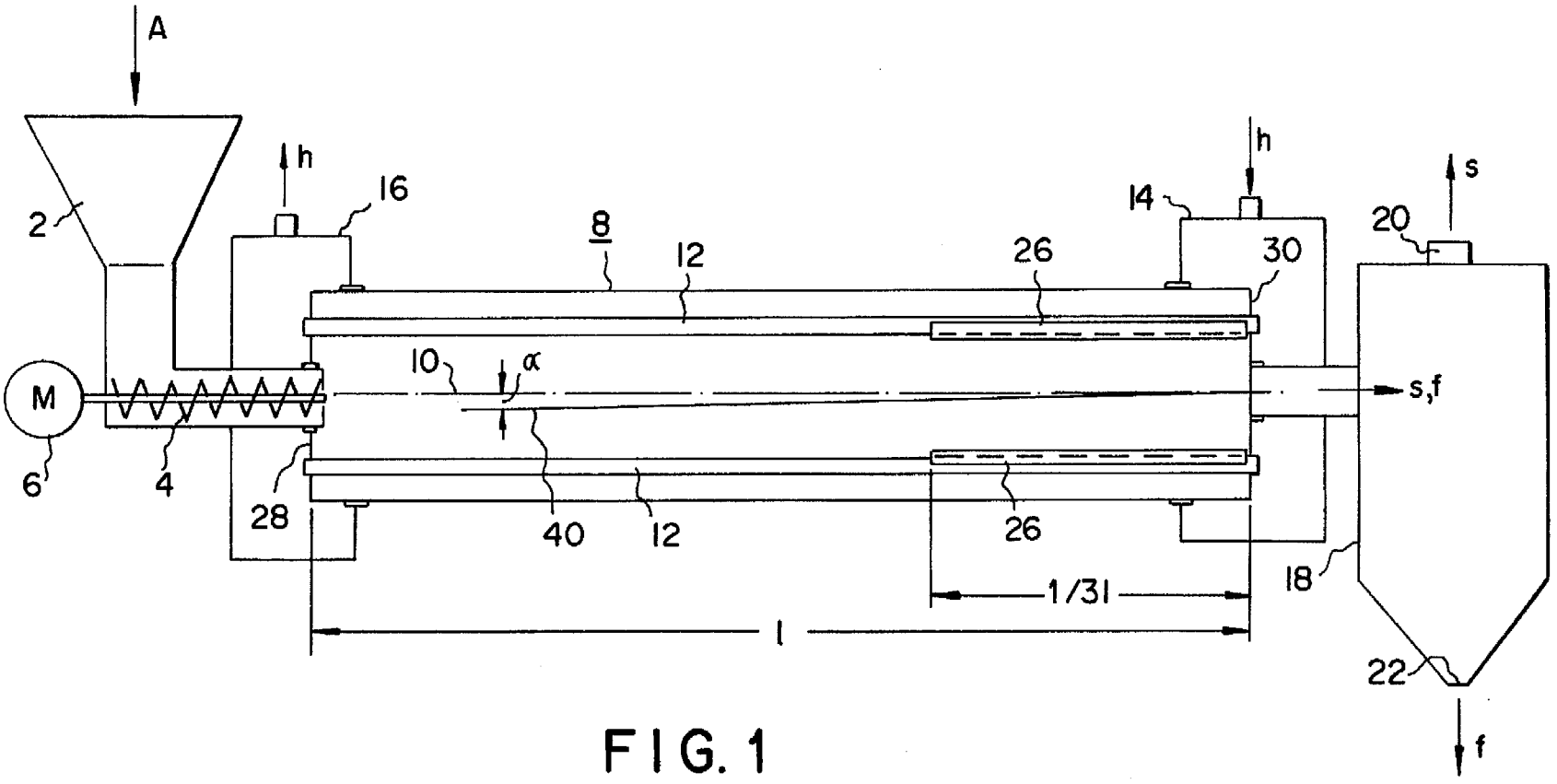
FIG. 1 is a diagrammatic, principle longitudinal-sectional view of a low-temperature carbonization plant for waste, which can be used in the context of a low-temperature combustion process.

Referring now to the figures of the drawing in detail and first, particularly, to FIG. 1 thereof, it is seen that solid waste A is introduced into a pyrolysis reactor or a low-temperature carbonization chamber 8 having a length 1, through a feed or delivery device 2 and a worm or screw 4 which is driven by a motor 6. In the exemplary embodiment, the low-temperature carbonization chamber 8 is a low-temperature carbonization or pyrolysis drum which is rotatable about its longitudinal axis 10 (by a non-illustrated drive). The drum 8 operates at 300° to 600° C., is operated substantially in the absence of oxygen and, apart from volatile low-temperature carbonization gas s, generates a substantially solid pyrolysis residue f. In this case the low-temperature carbonization drum 8 is provided in the interior thereof with tubes, namely a multiplicity of heating tubes 12 orientated parallel to each other, of which only two are shown. An inlet provided at one end for heating gas h is designated by reference numeral 14 and an outlet provided at the other end for the heating gas h is designated by reference numeral 16. The longitudinal axis 10 of the low-temperature carbonization chamber 8 is preferably at an angle $\alpha$ to the horizontal 40 so that the end on the right is lower than the inlet for the waste A shown on the left. A discharge apparatus 18 is connected downstream of the pyrolysis drum 8 on the exit side or discharge side. The discharge apparatus 18 is provided with a low-temperature carbonization gas take-off connection nozzle 20 for the escape of the low-temperature carbonization gas s and with a pyrolysis residue exit 22 for the delivery of the solid pyrolysis residue f. A non-illustrated low-temperature carbonization gas line connected to the low-temperature carbonization gas take-off connection nozzle 20 can be joined to a burner of a high-temperature combustion chamber.

It is of particular importance that the heating tubes 12 in an actual low-temperature carbonization part, which is situated on the right, are covered or provided with baffle shells 26. These baffle shells 26 extend over roughly ⅓ l, that is over one third of the total length l of the heating tubes 12. The total length can be, for example, 20 m and the individual diameter can be 8 to 10 cm. The baffle shells 26 are preferably semicircular casing pieces or half-shells. They are formed of steel and are welded onto the steel heating tubes 12 by tack welds. The baffle shells 26 can alternatively extend over a larger part of the total length 1 or else over the total length l. In any case, they protect the heating tubes 12 in the endangered region situated on the right, from falling solid material A in the form of stones, iron pieces, ceramic pieces, porcelain pieces, glass fragments and the like.

The baffle shells 26 are mounted before introducing the heating tubes 12 into the low-temperature carbonization chamber 8. The heating tubes 12 with the welded-on baffle shells 26 are introduced from the right through correspondingly large orifices in a right end plate 30 into the interior of the low-temperature carbonization chamber 8 and are then welded onto the end plate 30 and onto an end plate 28.

Figure 2:
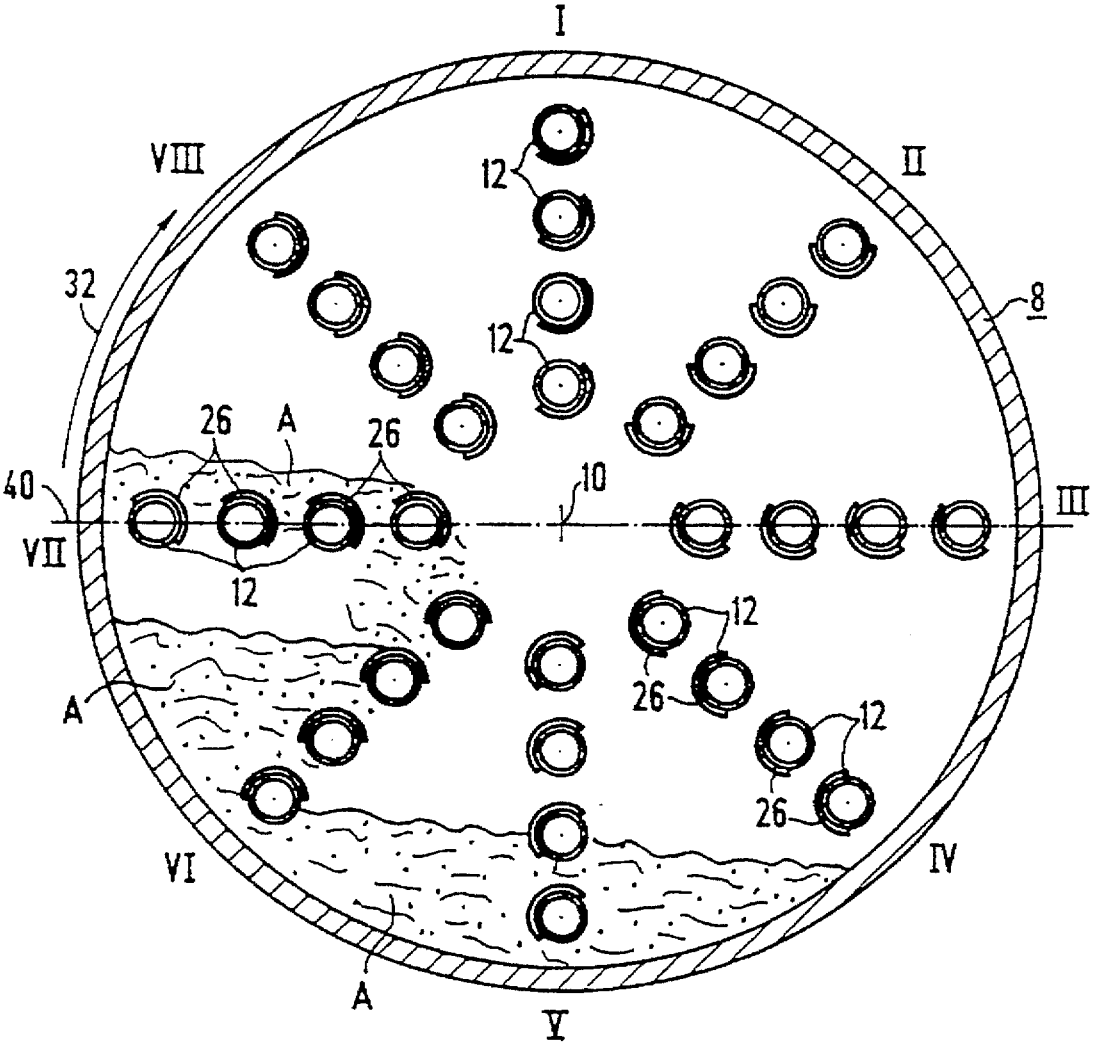
FIG. 2 is a cross-sectional view of a low-temperature carbonization chamber for waste, with heating tubes being disposed parallel to each other in rows that are essentially radially orientated.

According to FIG. 2, a low-temperature carbonization chamber 8 which is provided with internal tubes and which has a longitudinal axis 10 of the low-temperature carbonization chamber that can in turn be disposed at an incline, includes a multiplicity of heating tubes 12 disposed parallel to each other. The heating chamber 8 is rotatable about the longitudinal axis 10 in the direction of an arrow 32. In total, 8×4=32 heating tubes 12 are provided in the exemplary embodiment. However, this can be considerably more, for example more than one hundred. The heating tubes 12 are disposed next to each other in eight rows I to VIII, each having four heating tubes 12 in a radial direction. Each of the heating tubes 12 is provided with a resistant baffle shell 26. In the illustrated rotary position of the low-temperature carbonization chamber 8 which, for example, can have a diameter of 2.90 m, the row VI is positioned at an angle of about 45° to the horizontal 40 and to the lowest row V in the direction of rotation of the heating chamber 8. It can be seen from FIG. 2 that in this 45° position the baffle shells 26 cover the upper parts of the heating tubes (12) in the row VI.

The rotary position in which this orientation is reached can be in a preferred range from 30° to 60°. In this manner, virtually complete protection of the heating tubes 12 from falling lumps of waste A is ensured. That is to say it must be noted that the waste A is lifted up by the rotation in the direction of the arrow 32 and that with increasing elevation to an increasing extent the waste A detaches and falls down from the charge onto the heating tubes 12. The exact position in which that orientation of the hood-shaped protective shells 26 should occur is clearly dependent on the number and curvature of the rows I to VIII, on the type of waste A, on the distance of the individual heating tubes 12 from each other and on other factors. In the case of a large low-temperature carbonization drum 8, the orientation can thus be applied at an angle which is much smaller than 30° (from 30° to 45° in the preferred range).

We claim:

1. A solid waste treatment apparatus, comprising:

a heating chamber for solid material, said heating chamber having an interior and a longitudinal axis and being rotatable about the longitudinal axis;

a number of heating tubes disposed in said interior of said heating chamber; and baffle shells disposed on said heating tubes;

said heating tubes occupying different positions as said heating chamber rotates about the longitudinal axis, said positions including a lowest position of said heating tubes and a given position in which said heating tubes are in a range of 30° to 60° from said lowest position, as seen in a direction of rotation of said heating chamber, and said baffle shells covering parts of said heating tubes being upper parts when said heating tubes are in said given position.

2. The solid waste treatment apparatus according to claim 1, wherein said baffle shells are half-shells.

3. The solid waste treatment apparatus according to claim 1, wherein said heating tubes have a given total length, and said baffle shells extend over only part of said given total length.

4. The solid waste treatment apparatus according to claim 3, wherein said baffle shells extend over only about one third of said given total length.

5. The solid waste treatment apparatus according to claim 3, wherein the longitudinal axis of said heating chamber is disposed at an angle to the horizontal defining a lower end region of said heating tubes, and said baffle shells are mounted at said lower end region of said heating tubes.

6. The solid waste treatment apparatus according to claim 1, wherein said baffle shells are formed of steel.

7. The solid waste treatment apparatus according to claim 1, wherein said baffle shells are welded onto said heating tubes.

8. The solid waste treatment apparatus according to claim 1, wherein said heating tubes are disposed parallel to each other in substantially radial rows.

9. The solid waste treatment apparatus according to claim 1, wherein said heating tubes are approximately 45° from said lowest position in said given position.

10. A solid waste treatment apparatus according to claim 1, wherein said heating chamber is a low-temperature carbonization chamber for the waste.

11. A low-temperature solid waste carbonization apparatus, comprising:

a low-temperature carbonization chamber for solid waste, said chamber having an interior and a longitudinal axis and being rotatable about the longitudinal axis;

a number of heating tubes disposed in said interior of said chamber; and baffle shells disposed on said heating tubes;

said heating tubes occupying different positions as said heating chamber rotates about the longitudinal axis, said positions including a lowest position of said heating tubes and a given position in which said heating tubes are in a range of 30° to 60° from said lowest position, as seen in a direction of rotation of said heating chamber, and said baffle shells covering parts of said heating tubes being upper parts when said heating tubes are in said given position.

12. A solid waste treatment apparatus, comprising:

a heating chamber for solid material, said heating chamber having an interior and a longitudinal axis and being rotatable about the longitudinal axis;

a number of heating tubes disposed in said interior of said heating chamber and having a given total length; and baffle shells disposed on said heating tubes and extending over only one third part of said given total length of said heating tubes.

13. A solid waste treatment apparatus, comprising:

a heating chamber for solid material, said heating chamber having an interior and a longitudinal axis and being rotatable about the longitudinal axis;

a number of heating tubes disposed in said interior of said heating chamber; and baffle shells disposed on said heating tubes, said heating tube have a given total length, and said baffle shells extend over only part of said given total length, wherein the longitudinal axis of said heating chamber is disposed at an angle to the horizontal defining a lower end region of said heating tubes, and said baffle shells are mounted at said lower end region of said heating tubes.

* * * * *